US009980552B2

(12) United States Patent
Maguire et al.

(10) Patent No.: US 9,980,552 B2
(45) Date of Patent: May 29, 2018

(54) WEARABLE SUPPORTS

(71) Applicant: CAMPBELL AND SCOTT LTD., Dunedin (NZ)

(72) Inventors: Patrick David Maguire, Dunedin (NZ); Gary Alan Gibson, Dunedin (NZ); Campbell Allen Booth, Dunedin (NZ); Timothy Kent Armstrong, Dunedin (NZ)

(73) Assignee: CAMPBELL AND SCOTT LTD., Dunedin (NZ)

( * ) Notice: Subject to any disclaimer, the term of this patent is extended or adjusted under 35 U.S.C. 154(b) by 0 days. days.

(21) Appl. No.: 15/151,486

(22) Filed: May 10, 2016

(65) Prior Publication Data

US 2016/0249730 A1 Sep. 1, 2016

Related U.S. Application Data

(62) Division of application No. 13/884,864, filed as application No. PCT/NZ2011/000240 on Nov. 11, 2011, now abandoned.

(60) Provisional application No. 61/412,582, filed on Nov. 11, 2010.

(30) Foreign Application Priority Data

Nov. 11, 2010 (NZ) ..... 589201

(51) Int. Cl.

| | |
|---|---|
| ***A45F 3/10*** | (2006.01) |
| ***A45F 3/04*** | (2006.01) |
| ***A45F 3/00*** | (2006.01) |

(52) U.S. Cl.
CPC ..... *A45F 3/10* (2013.01); *A45F 3/005* (2013.01); *A45F 3/04* (2013.01); *A45F 2003/045* (2013.01)

(58) Field of Classification Search
CPC ..... A45F 3/10; A45F 3/04; A45F 2003/045
See application file for complete search history.

(56) References Cited

U.S. PATENT DOCUMENTS

| | | | |
|---|---|---|---|
| 3,840,162 | A | 10/1974 | Horenstein et al. |
| 4,303,186 | A | 12/1981 | Ollinger, IV |
| 5,090,604 | A | 2/1992 | Howe |
| 5,954,253 | A | 9/1999 | Swetish |
| 6,199,732 | B1 | 3/2001 | Swetish |
| 2005/0082330 | A1 | 4/2005 | Fehlberg et al. |
| 2008/0035686 | A1 | 2/2008 | Gregory |

FOREIGN PATENT DOCUMENTS

| | | |
|---|---|---|
| DE | 010033738 | 1/2002 |
| EP | 2172126 | 4/2010 |
| WO | WO2007056828 | 5/1997 |
| WO | WO9749312 | 12/1997 |

*Primary Examiner* — Corey Skurdal
(74) *Attorney, Agent, or Firm* — Greer, Burns & Crain, Ltd.

(57) ABSTRACT

A wearable support assembly is provided which includes a belt strap configured to be secured about a user's hips/waist and a carrier frame which is pivotally attached to the belt strap at two pivot points which are spaced apart along the belt strap to create a substantially lateral pivot axis when the belt is worn by the user, where the relative position of the two pivot points can be adjusted with respect to the belt, the carrier frame is located behind the user when the support assembly is worn by the user and the carrier frame spans the distance between each pivot point on the belt strap with a gap separating the belt strap and the carrier frame.

15 Claims, 5 Drawing Sheets

WEARABLE SUPPORTS

STATEMENT OF CORRESPONDING APPLICATIONS

This application is a divisional application of and claims priority to U.S. patent application Ser. No. 13/884,864 filed on Jul. 29, 2013, which claims priority to and the benefit of Provisional specification filed in relation to New Zealand Patent Application Number 589201, the entire contents of which are incorporated herein by reference.

TECHNICAL FIELD

The present invention relates to improvements in and relating to wearable supports. In particular, wearable supports that are worn to assist with a person carrying a load.

BACKGROUND ART

Over the years many wearable supports for assisting a person carrying a load have been developed. For example, tramping back packs have been developed with sophisticated frame harnesses, and strap arrangements, to allow for more items and heavier loads to be carried more comfortably by a single person.

Wearable supports are also often attached to devices such as vacuum cleaning apparatus to allow this to be worn rather than dragged behind a person to increase the ease and efficiency of the vacuuming operation.

As can be seen from the above two examples wearable supports have been developed over the years to allow for various objects to be carried on the back of a person rather than them having to transport the objects separately by pushing, pulling, or carrying the objects in their arms.

To remove some of the load from the shoulders of the wearer many wearable supports feature a waist belt which transfers a portion of the load onto the user's waist or hips.

However, despite the advances that have been made in wearable supports to date, there still exists a need for a wearable support which can enable a load, from one or more objects, to be carried on a person's back in a manner which allows the person's torso a greater freedom of movement.

US 2005/0082330 discloses a pack support which is designed to give a person a greater degree of unrestricted movement. The pack has shoulder straps and a waist belt. However, whilst this pack achieves greater freedom of movement, it does so at a cost, namely; having to break a frictional connection between the pack and the waist belt, which then, as a consequence, places a greater strain upon a user's shoulders and spine.

US 2008/0035686 is concerned with a backpack having a pivot system between a waist belt and a frame which supports one or more packs (bags). Again this system is concerned with user comfort and providing a mechanism to provide a backpack wearer with a greater degree of flexibility. This pivot system allows for a person to flex in the coronal plane by virtue of pivot axis 210 as shown for example in FIG. 4b. However, it does not allow a person to flex in the sagittal plane.

Moreover, neither system provides an ideal solution to reducing the strain on a person's back whilst maintaining a reasonable degree of flexibility.

There is also a need for a wearable support which can carry items in a manner wherein at least a portion of the load is carried adjacent a person's centre of mass. In particular, a wearable support which is capable of carrying the heaviest parts of a load adjacent to a person's centre of mass would be useful.

It would also be useful if there could be provided a wearable support which is configured to support one or more modules in a manner which enables a module to pivot about a lateral axis.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

DISCLOSURE OF THE INVENTION

According to one aspect of the present invention there is provided a wearable support assembly which includes:

- a belt strap which is configured to be secured about a user's hips/waist; and
- a carrier frame which is pivotally attached to the belt strap at two pivot points which are sufficiently spaced apart along the belt strap so as to create a lateral pivot axis when the belt is worn by the user, wherein the relative position of the two pivot points can be adjusted with respect to the belt.

According to another aspect of the present invention there is provided a wearable support as above wherein the lateral pivot axis may run substantially through a person's centre of mass.

According to another aspect of the present invention there is provided a wearable support assembly as above wherein the relative position of the two pivot points can be adjusted with respect to the belt to remain substantially centrally positioned with respect to a person's ventral and dorsal surfaces. This adjustment allowing the wearable support assembly to accommodate people of different sized girths.

According to another aspect of the present invention there is provided a wearable support assembly substantially as described above wherein the pivot points where the carrier frame is pivotally attached to the belt strap include a mechanism to limit the amount of rotation.

As used herein the term 'lateral pivot axis' refers to a pivot axis which exists in both a transverse plane and the coronal plane with respect to a wearer which allows the wearer to bend their torso forward. Thus, it will be understood a lateral pivot axis runs through the left and right hand side of a human body. It will be appreciated by a person skilled in the art that the belt portion may also be ascribed with the same sagittal, coronal and transverse reference planes as a human wearing the belt.

In an average human body the 'centre of mass' is located around the lower abdominal region around the waist and hips.

The belt may take any number of forms without departing from the scope of the present invention.

In general the belt may be in the form of a strap which has an adjustable connection device at one or both ends thereof to allow the belt to be adjusted to fit snugly about a person's waist.

In one preferred embodiment the belt includes a connection device in the form of a snap fit connector.

In another embodiment the belt includes a connection device in the form of a buckle.

In a further embodiment the belt includes a connection device in the form of a pair of hook and loop strips—such as those manufactured under the VELCRO™ brand.

According to another aspect of the present invention there is provided a wearable support as above wherein the belt strap has a width of substantially 50-150 mm. The inventors have found that the wider the belt the better it can support the lower back as well as abdominal region between a person's hips and ribs.

In some preferred embodiments the belt may include at least one reinforcing member which is made from an at least partially rigid material.

In one preferred embodiment the belt may include a strip of polypropylene therein, which spans between the two pivot points. One function of the reinforcing member is to help spread the load transferred to the belt from the carrier frame in a manner which prevents the belt from twisting or folding.

The carrier frame may have a number of different configurations without departing from the scope of the present invention.

In preferred embodiments the carrier frame may be made from a substantially rigid material.

The carrier frame may be generally C-shaped or U-shaped.

In general, the carrier frame and belt strap of the wearable support apparatus may be located in a common transverse plane with respect to a person wearing the wearable support apparatus and standing in a substantially upright position, the carrier frame being capable of pivoting with respect to the belt strap and moving out of the common plane when a person bends forward.

In a preferred embodiment the carrier frame is configured so that the ends thereof which are connected to the belt strap can be extended and/or retracted so that the width of the lateral pivot axis can be adjusted for people with different sized waists. For example, the ends of the carrier frame may be telescopic nature.

In an alternate embodiment the carrier frame and/or belt strap may be configured to have multiple points for pivotal attachments therebetween.

Preferably, the carrier frame may be configured to provide a gap between the carrier frame and the region of the belt to which the carrier frame is adjacent. This gap helps ensure that the region of the carrier frame which spans between the pivot points attaching the carrier frame to the belt strap, can freely pivot with respect to the belt. In other words this gap helps prevent frictional interference between the surface of the carrier frame and the belt strap hindering pivotal movement. This gap also allows a person to more freely twist their torso.

In some preferred embodiments the carrier frame has an upright frame to which objects can be attached.

The pivot points may come in a variety of different forms without departing from the scope of the present invention.

In one embodiment the pivot points may be in the form of a pivot and a bearing assembly.

In another preferred embodiment the pivot points may be in the form of a pivot and socket assembly in which the pivot can rotate and wherein the pivot and socket are both made from materials having a low friction coefficient such as polypropylene.

In further preferred embodiments the pivot points may be configured to limit the amount of rotation the carrier frame can undergo. Preferably, the pivot point may be configured to prevent the carrier frame pivoting away from the belt strap past a position in which it is substantially parallel with the transverse plane of the belt strap. Most preferably, the pivot point may also be configured to prevent the carrier frame from pivoting toward the belt strap past a predetermined point.

In some other embodiments the belt strap and/or carrier frame may be configured to prevent the carrier frame pivoting away from the belt strap past a position in which it is substantially parallel with the transverse plane of the belt strap. For example, the belt strap may have a hook arm which engages the carrier frame to prevent the carrier frame from rotating past parallel.

In general the amount of rotation will be from around 45° to 60° with respect to the transverse plane of the belt strap.

The pivot points may be considered spaced sufficiently apart when they are each located on opposite sides of a human body.

A wearable support assembly substantially as described above wherein the belt strap and/or carrier frame include one or more mounting points to which one or more objects can be removably attached.

In a preferred embodiment the one or more mounting points are in the form of a socket (female part) in to which a male part is located to connect at least one object thereto. Obviously, the mounting point could equally be a male part onto which a female part is located.

The objects may be anything one wants to carry or support on the wearable support assembly.

In some embodiments the objects may be in the form of an appliance and associated power source. For example, the appliance may be a vacuum cleaning apparatus and the power source may be a battery pack.

However this should not be seen as limiting as the appliance could be any number of apparatus such as detailed in the following non-limiting list of examples:

- A fluid reservoir tank or bladder and spray/fluid delivery assembly;
- A motorised hedge trimmer;
- A leaf blower;
- Communication equipment;
- Computer hardware; and/or
- Military hardware.

In one preferred embodiment the object is a pack frame and haversack.

The objects may preferably be attached to the top and/or side of the carrier frame.

The objects attached to the carrier frame may include one or more shoulder straps which additionally assist with carrying the load.

Thus, preferred embodiments of the present invention may have a number of advantages over the prior art which may include one or more of the following:

Providing a wearable support assembly which enables a person to carry a load near their centre of gravity;

Providing a wearable support assembly which has a waist belt which allows for transfer of load from a person's shoulders to their waist/hips;

Providing a wearable support assembly which allows for a greater degree of forward torso flex whilst still fully supporting the load to be carried;

Providing a wearable support assembly which allows for lateral torso flex;

Providing a wearable support assembly which maintains load stability during forward or lateral torso flex;

Providing a wearable support assembly which allows a person to more freely twist their torso about a vertical axis.

In another embodiment, A wearable support assembly is provided which includes a belt strap configured to be secured about a user's hips/waist and a carrier frame which is pivotally attached to the belt strap at two pivot points which are spaced apart along the belt strap to create a substantially lateral pivot axis when the belt is worn by the user, where the relative position of the two pivot points can be adjusted with respect to the belt, the carrier frame is located behind the user when the support assembly is worn by the user and the carrier frame spans the distance between each pivot point on the belt strap with a gap separating the belt strap and the carrier frame.

BRIEF DESCRIPTION OF THE DRAWINGS

Further aspects of the present invention will become apparent from the following description which is given by way of example only and with reference to the accompanying drawings in which.

BEST MODES FOR CARRYING OUT THE INVENTION

Figure 1:
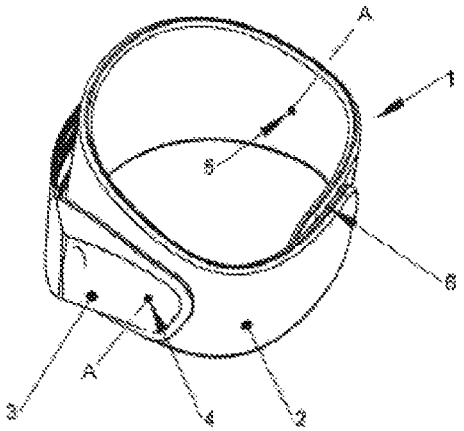
FIG. 1 shows a perspective schematic view of a wearable support assembly according to one preferred embodiment.
Figure 2:
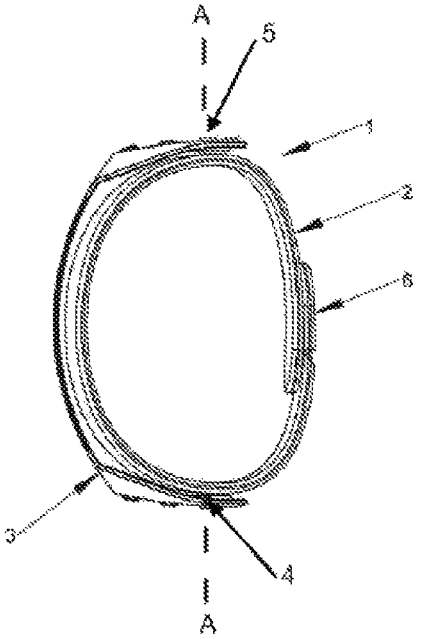
FIG. 2 shows a plan view of wearable support assembly shown in FIG. 1.
Figure 3:
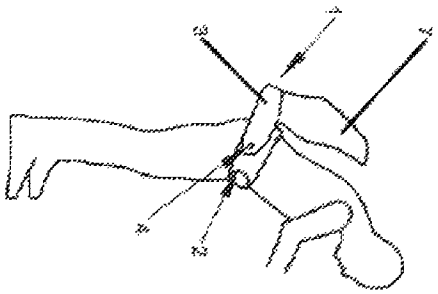
FIG. 3 shows a schematic side view of the wearable support assembly shown in FIG. 2 wherein it is being worn by a person who is bending forward.

With respect to FIGS. 1-3 there is shown a wearable support assembly (WSA) generally indicated by arrow 1. The WSA 1 has a belt strap 2 and a carrier frame 3. The carrier frame 3 is pivotably attached to belt strap 3 at two pivot points 4 and 5. The pivot points 4 and 5 create a lateral pivot axis indicated by dotted line A-A. The belt strap is opened and closed by VELCRO™ strips (not shown) at the respective ends of the belt strap in the region indicated by arrow 6.

Figure 4:
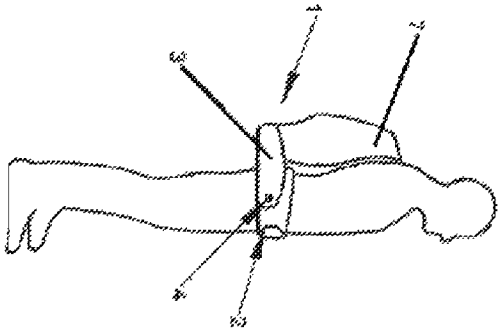
FIG. 4 shows a schematic side view of the wearable support assembly shown in FIG. 3 wherein the person is standing upright.

As can be seen in FIGS. 3 and 4 the carrier frame 3 can be connected to an object such as a minipack 7 which is in the form of a foam covered rigid shell into which items to be carried can be placed. The minipack 7 may be removably connected to the carrier frame 3 via a number of mounting points (not shown). As can be seen the minipack 7 given its relatively small size does not require any shoulder straps for a person to carry the load therein.

Figure 5:
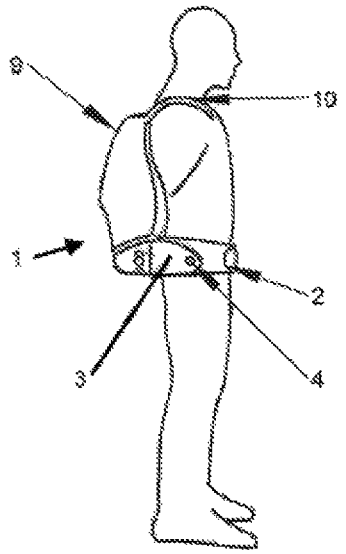
FIG. 5 shows a schematic side view of the wearable support assembly wherein the person is standing upright and wearing a wearable support assembly which is carrying multiple objects.

In FIG. 5 the WSA 1 is being used to carry multiple loads. The first load being carried is an object in the form of a minipod 8 which holds a battery pack.

The second load is an object in the form of a vacuum cleaning apparatus herein simply referred to as a 'VCA' represented by arrow 9. The weight of the VCA requires the use of shoulder straps 10 to further assist the carrier frame 3 with carrying the load. Thus, quite unlike conventional backpacks the shoulder straps do not carry the majority of the load with the waist belt being merely a means to transfer some of that load to a person's abdominal region.

Figure 6:
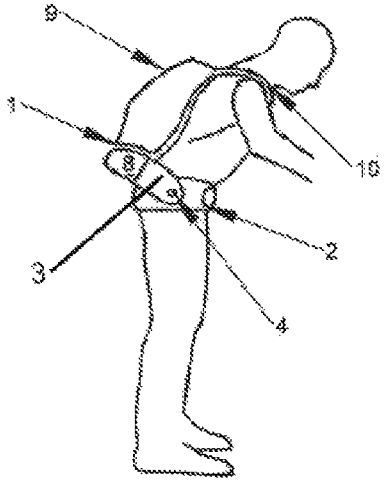
FIG. 6 shows a schematic side view of the wearable support assembly shown in FIG. 6 wherein the person is bending forward.

In FIG. 6 it can be seen how the carrier frame 3 pivots with respect to the belt strap 2 to facilitate a person bending forward.

Figure 7:
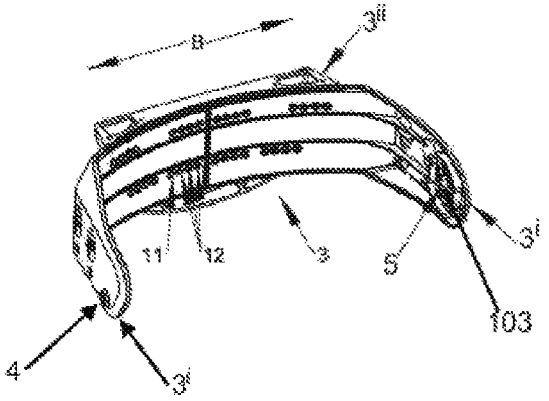
FIG. 7 shows a perspective view of a carrier frame in accordance with one preferred embodiment of the present invention.

In FIG. 7 the carrier frame 3 is shown in greater detail to illustrate how the relative distance of the respective pivot points 4 and 5 on the left and right hand side of a person can be adjusted. As shown the carrier frame 3 has a body portion $\mathbf{3}^{ii}$ which is hollow and into which an end portion 3 can telescope in the direction of double headed arrow B. The end portion 3 which is located within body portion $\mathbf{3}^{ii}$ has sprung dome 11 which is biased towards apertures 12 in the body portion $\mathbf{3}^{ii}$. Once the dome is aligned with an aperture 12 it can project therethrough to lock the end portion $\mathbf{3}^{i}$ in the desired position given a person's girth. To alter the position of $\mathbf{3}^{i}$ simply requires depressing dome 11 and sliding the end $\mathbf{3}^{i}$ to the desired aperture 12.

Figure 8:
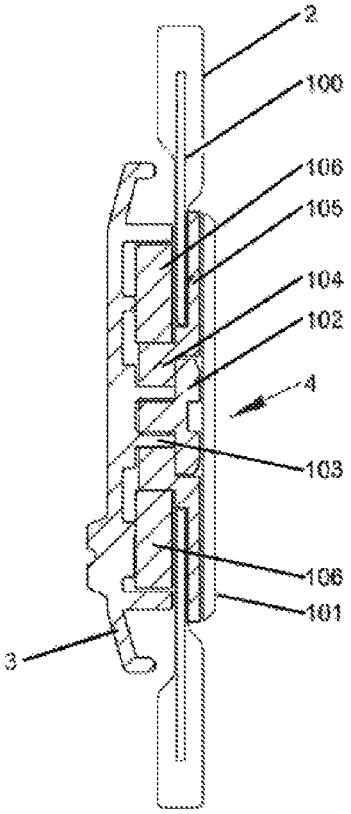
FIG. 8 shows a schematic enlarged cross sectional view of a belt strap and the pivot points connecting it to the carrier frame in accordance with one preferred embodiment of the present invention.
Figure 9:
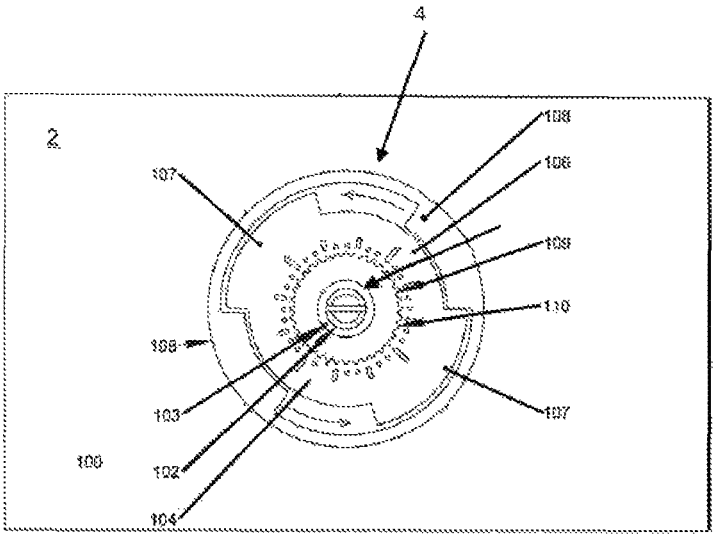
FIG. 9 shows a partial cut away schematic side view of the pivot points shown in FIG. 8.

In FIGS. 8 and 9 there is shown a belt strap 2 made of EVA foam which encases a reinforcing member in the form of a length of polypropylene 100 which spans the length of belt strap 2 between the two pivot points 4 and 5 (of which only one pivot point 4 is shown). An EVA foam cap 101 covers a pan head screw 102 which is threadably engaged with a pivot in the form of pivot shaft 103 which projects out from end portion 3' of the carrier frame 3 (as can be seen in FIG. 7). The pivot shaft 103 rotates within a polypropylene bearing socket 104 which is the inner radial surface of a toothed ring 104 extending from a pivot base 105.

The pivot point 4 also has a rotation limiter in the form of a removable locking disc 106. The removable disc 106 has outwardly projecting radial tabs 107 which act as shoulders which prevent rotation of the carrier frame 3 when the tabs 107 come to abut against inwardly projecting radial stop tabs 108 on end portion $\mathbf{3}^{i}$.

The locking disc 106 is held in place by teeth 109 which engage cooperating teeth 110 on bearing socket 103.

The connection part 400 is screwed at points 401 to the end portion $\mathbf{3}^{i}$ of carrier frame 3. When a person bends forward from the upright position shown in FIG. 9, the connection part 400 can rotate to the position shown by the dotted lines until tabs 108 abut tabs 107.

Aspects of the present invention have been described by way of example only and it should be appreciated that modifications and additions may be made thereto without departing from the scope thereof as defined in the appended claims.

What is claimed is:

1. A wearable support assembly which includes:

a belt strap which is configured to be secured about a user's body; and a carrier frame which is pivotally attached at opposite ends thereof to the belt strap at two pivot points which are spaced apart along the belt strap so as to create a substantially lateral pivot axis when the belt is worn by the user, wherein the carrier frame spans the distance between each of the pivot points on the belt strap with a gap separating the belt strap and the carrier frame, the carrier frame and the belt strap are located in a common transverse plane relative to the user wearing the wearable support and standing in a substantially upright position; and wherein the carrier frame has opposite ends connected to the belt strap where the ends are telescopically extended or contracted along a transverse axis so that the width of the lateral pivot axis is adjustable, prior to being worn by the user, to accommodate users with different sized waists.

2. The wearable support assembly of claim 1, wherein the lateral pivot axis passes substantially through the user's center of mass.

3. The wearable support assembly of claim 1, wherein the belt strap has a width of substantially 50-150 mm.

4. The wearable support assembly of claim 1, wherein the belt includes at least one reinforcing member which is made from an at least partially rigid material.

5. The wearable support assembly of claim 4, wherein the at least one reinforcing member is a strip of polypropylene which spans between the two pivot points.

6. The wearable support assembly of claim 1, wherein the carrier frame is made from a substantially rigid material.

7. The wearable support assembly of claim 1, wherein the carrier frame is configured to provide a gap between the carrier frame and the region of the belt to which the carrier frame is adjacent.

8. The wearable support assembly of claim 1, wherein the carrier frame has an upright frame to which objects can be attached.

9. The wearable support assembly of claim 1, wherein the pivot points are in the form of a pivot and a bearing assembly.

10. The wearable support assembly of claim 1, wherein the pivot points are in the form of a pivot and socket assembly in which the pivot can rotate.

11. The wearable support assembly of claim 10, wherein the pivot and socket assembly are both made from materials having a low friction coefficient.

12. The wearable support assembly of claim 1, wherein the pivot points are configured to limit the amount of rotation the carrier frame can undergo relative to the belt strap.

13. The wearable support assembly of claim 12, wherein the pivot points are configured to prevent the carrier frame from pivoting away from the belt strap past a position in which it is substantially parallel with the transverse plane of the belt strap.

14. The wearable support assembly of claim 12, wherein the pivot points are configured to prevent the carrier frame from pivoting toward the belt strap past a predetermined point.

15. The wearable support assembly of claim 1, wherein said opposite ends of said carrier frame are movably connected to each other.

* * * * *